United States Patent [19]

Herrick

[11] Patent Number: 4,541,309

[45] Date of Patent: Sep. 17, 1985

[54] TORQUE WRENCH

[76] Inventor: Jerome N. Herrick, P.O. Box 11267, Oakland, Calif. 94611

[21] Appl. No.: 570,657

[22] Filed: Jan. 13, 1984

[51] Int. Cl.[4] ..... B25B 13/00; B25B 13/46

[52] U.S. Cl. ..... 81/57.46; 81/57.39

[58] Field of Search ..... 81/57.39, 57.42, 57.46, 81/60

[56] References Cited

U.S. PATENT DOCUMENTS

| | | | |
|---|---|---|---|
| 2,009,409 | 7/1935 | Parker | 81/57.46 |
| 2,603,998 | 7/1952 | Schwartz | 81/57.46 |
| 2,690,689 | 10/1954 | Batcha | 81/57.46 |
| 3,786,698 | 1/1974 | Diehl et al. | 81/57.39 |

*Primary Examiner*—James G. Smith

*Attorney, Agent, or Firm*—Manfred M. Warren; Robert B. Chickering; Glen R. Grunewald

[57] ABSTRACT

A power torque wrench operated by pulling a flexible tension element tangentially from a drum which is connected through ratchet means to a coaxial driver and having a second tension element wrapped around the drum in the opposite direction so that the work stroke of the motor winds the second tension element around the drum and the return stroke of the motor winds the first tension element around the drum.

7 Claims, 4 Drawing Figures

TORQUE WRENCH

FIELD OF THE INVENTION

This invention is in the field of power torque wrenches.

BACKGROUND OF THE INVENTION

Power torque wrenches are used where many threaded fasteners are employed or when a threaded element must be employed with a limit on the amount of torque applied to it. Typical examples are connecting two large diameter pipes together with a pair of flanges wherein many nut-bolt combinations must be taken up and tightened to a predetermined torque. A power torque wrench saves hours of labor as compared with using a handoperated torque wrench and is especially useful where high torque must be employed.

A power torque wrench must have a small enough head to be used in the space available for its operation. For example, when taking up and tightening nut-bolt combinations between two flanges, the head of the torque wrench must fit between the pipe wall and the flange. In other words, the driver cannot be surrounded by so much mechanism that it cannot engage the nut it is used to tighten. It is also beneficial that the device be lightweight, easy to use, rugged enough to function in a dirty environment or in any horizontal or vertical orientation and it must move rapidly enough to run down the nut but still have controllable torque for final tightening.

Prior power torque wrenches use a variety of approaches to regulate the torque that is applied. One successful approach is to create torque by pulling a flat chain or other tension member from a drum or cylindrical surface that rotates around the driver. As used in this specification, the driver is that part of the wrench that grips the nut or valve head or other device to which torque is applied. A hydraulic or pneumatic piston-cylinder arrangement can pull the chain of such a wrench with a predetermined force so that the torque created by unwrapping the chain from the cylinder is established at the driver positioned at the center of rotation of the cylinder. When the force pulling on the chain is established at a certain level, when that amount of torque is applied to a nut or bolt it will tighten no further. One device of this nature is disclosed in U.S. Pat. No. 3,633,446.

In order to maintain the torque at the desired level, it is necessary that the chain be wrapped on the cylindrical surface in a single layer. If multiple layers are employed, the effective diameter of the cylinder or drum changes. It is also important that the cylinder from which the chain is pulled be small in diameter in order to conserve space around the driver. Accordingly, a power torque wrench driven by a flat chain pulled tangentially from a cylinder employs a small cylinder to conserve space and employs short strokes from the motor so that the cable pulled from the cylinder will cause it to rotate slightly less than 360° per stroke. On such a device it is required to provide means to return the cylinder to its original position to re-wrap the chain around it.

Usually the cylindrical surface is mounted to an internal drive mechanism that employs a ratchet with a spring mechanism within the ratchet to provide the power to rewind the chain on the cylinder. Rewinding is done on what is called the return stroke. The use of the spring within the cylinder-ratchet assembly requires the use of space which enlarges the head. Also, since the head must be maintained as small as possible, a large spring cannot be used and the spring force from a small spring is limited. In addition, as the spring powers the return stroke, the rewinding force diminishes and as a result the return stroke is slow and frequently the spring does not completely rewind the device. With the limited force applied by a spring, particularly a small spring that will not overly enlarge the head of the torque wrench, the device becomes sensitive to dirt, lack of lubrication, and orientation with regard to vertical and horizontal. In addition the constant but unpredictable spring force will influence the torque provided by a wrench on its power stroke.

As used in this description, the term torque wrench includes devices that apply predetermined torque to rotating means or elements and it includes within its terms ordinary torque wrenches as well as screwdriving devices, devices to operate valves, door actuators and the like.

As used in this specification the term "motor" includes any power device that exerts force to pull the chain or tension element employed in this invention. Typically the motor will be a hydraulic or pneumatic piston-cylinder combination but the term is not limited to such devices.

The term chain or tension element includes any elongated flexible element that is capable of being wrapped around a cylinder and is able to resist a tension-producing force. Examples of tension elements are rope, cable, wire, chain and the like.

The term cylindrical surface, spool, drum and the like are used interchangeably in this specification to indicate a cylindrical element capable of rotating symmetrically around an elongated axis.

The term ratchet means includes any device that produces relative rotary motion between two elements in one direction that causes them to rotate together in the opposite direction. A typical ratchet-means is a ratchet.

DETAILED DESCRIPTION OF THE INVENTION

Figure 1:
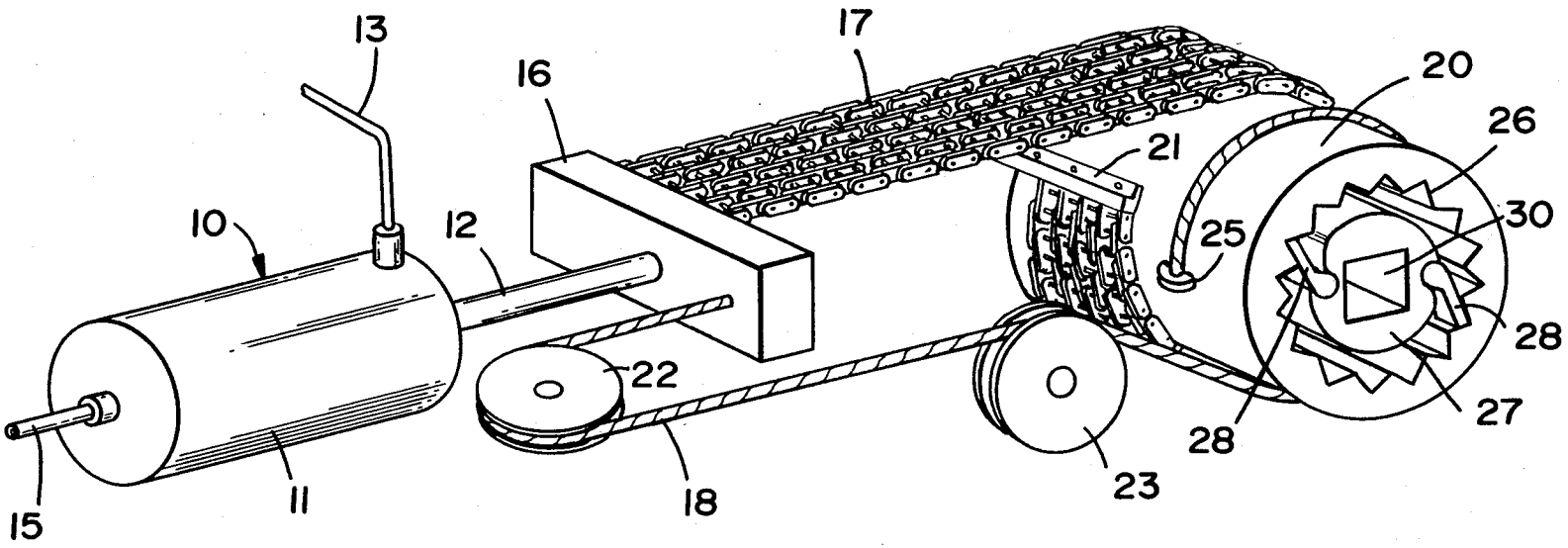
FIG. 1 is a perspective, schematic view of a wrench embodying this invention.

FIG. 1 illustrates schematically a torque wrench embodying this invention. The torque wrench includes a motor 10 which motor includes a cylinder 11, a piston operating within the cylinder that cannot be seen in this view and a piston rod 12 which is a rigid rod that is actuated by movement of the piston within the cylinder. The motor 10 is actuated by hydraulic fluid entering line 13 to move rod 12 from right to left, which is the power stroke of the wrench, and it is provided with a source of compressed air to line 15 to move the piston from left to right to provide the return stroke of the torque wrench of this invention. Suitable valving known to the art is provided in lines 15 and 13, although not illustrated, to alternately provide high-pressure air through line 15 and to vent it, and to alternately provide high-pressure hydraulic fluid through line 13, and to return it to a suitable sump.

Piston rod 12 is connected to a yoke 16 which in turn is connected rigidly to a first tension element 17 which is a flat chain and a second tension element 18 which is a cable. First tension element 17 is wrapped around cylinder 20 slightly less than completely around it and fastened with fastening means 21 to fix it firmly to the surface of cylinder 20. Second tension element 18 is held on the opposite side of yoke 16 and passes around pulleys 22 and 23 and then wraps tangentially around cylinder 20 the same amount that first tension element wraps around cylinder 20. Tension element 18 is wrapped around cylinder 20 in the opposite direction from the direction element 17 is wrapped and it is fastened to the surface of cylinders 20 with suitable fastening means not shown in this view.

Cylinder 20 is provided internally with teeth 26 that are buttressed in shape to be suitable for use as ratchet teeth. Within cylinder 20 is a ratchet element 27 that is generally cylindrical in shape and is provided with ratchet pawls 28 which interconnect ratchet element 27 with teeth 26 in the usual manner.

A driver 30 is formed in or connected to at least one and preferably both ends of ratchet element 27 to engage with a socket or equivalent tool or to engage directly with a nut or other element that the wrench is to turn.

In operation driver 30 engages a nut or an equivalent element and hydraulic fluid is then introduced through line 13 to drive a piston within cylinder 10 in a direction from right to left as illustrated in FIG. 1. As a result, rod 12 moves from right to left and creates tension in first tension element 17 whereby it is pulled tangentially from cylinder 20 causing cylinder 20 to rotate in a counter-clockwise direction as illustrated in FIG. 1. When the cylinder 20 rotates in a counterclockwise direction the pawls 28 engage teeth 26 so that ratchet element 27 rotates with cylinder 20 along with driver 30 that is formed within or connected to ratchet element 27. A threaded element such as bolt engaged with driver 30 will be turned by rotation of cylinder 20 in a direction such that a righthand thread will be driven into a corresponding internally threaded element such as a nut.

The counterclockwise rotation of cylinder 20 causes second tension element 18 to wrap around the cylinder 20 while tension element 17 is unwrapping. At the end of the right to left stroke of piston rod 12, tension element 18 will be wrapped around the cylinder an amount exactly corresponding to the amount that tension element 17 was unwrapped from the cylinder by that stroke.

At the end of the power stroke valving known to the art will cause line 13 to be opened so that hydraulic fluid may flow freely toward a sump and valving known to the art will cause compressed air to enter tube 15 on the opposite side of the piston from the hydraulic fluid whereby piston rod 12 will move from left to right. As piston rod 12 moves from left to right, tension element 18 is put in tension and it is pulled tangentially from the underside of cylinder 20 whereby it drives cylinder 20 in a clockwise direction causing tension element 17 to be wrapped around it. When cylinder 20 is moved in a clockwise direction, pawls 28 do not engage ratchet element 27 and as a consequence ratchet element 27 does not rotate with cylinder 20.

Alternating movements of piston rod 12 first from right to left and then from left to right will cause any element engaged in driver 30 to rotate in a counterclockwise direction as viewed in FIG. 1 which in turn will cause a threaded element with a righthand thread to be driven into a corresponding threaded element. When the threaded element is driven with the predetermined torque, as established by the pressure of hydraulic fluid and supplied through line 13, the driver will simply stall. If it is desired to remove a righthand threaded element or to drive a lefthand threaded element, a driver corresponding to driver 30 may be positioned at the opposite end of ratchet element 27.

The device illustrated in FIG. 1 requires no springs to power the rewinding of tension element 17 and therefore it may be of small diameter which conserves the critical space necessary for driver 30 to engage with a nut or bolt. In addition, the only limit to how much force is used to rewind tension element 17 is the pneumatic pressure in line 15. Pneumatic pressure in cylinder 10 can provide a rapid and forceful rewinding which requires, not only that cylinder 20 be rewound, but that hydraulic fluid be urged out of cylinder 10 through line 13.

Figure 2:
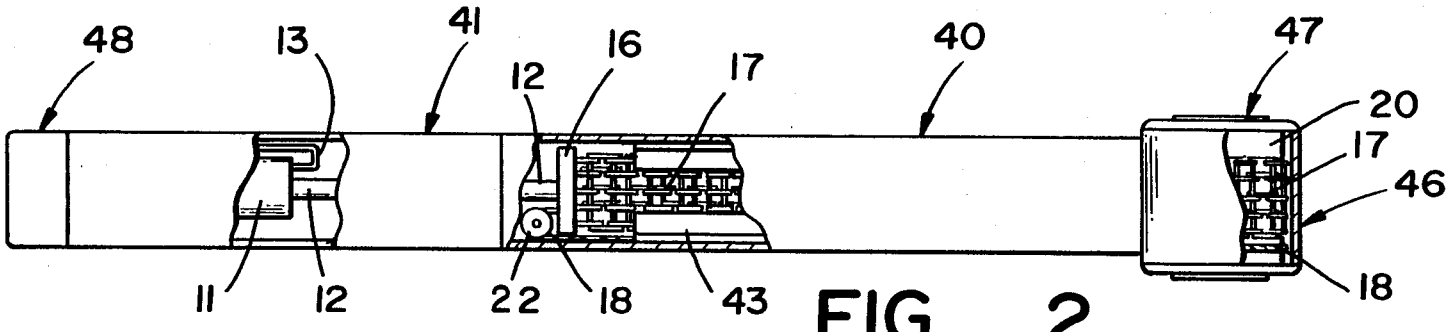
FIG. 2 is a partly cut-away plan view of a wrench embodying this invention.
Figure 3:
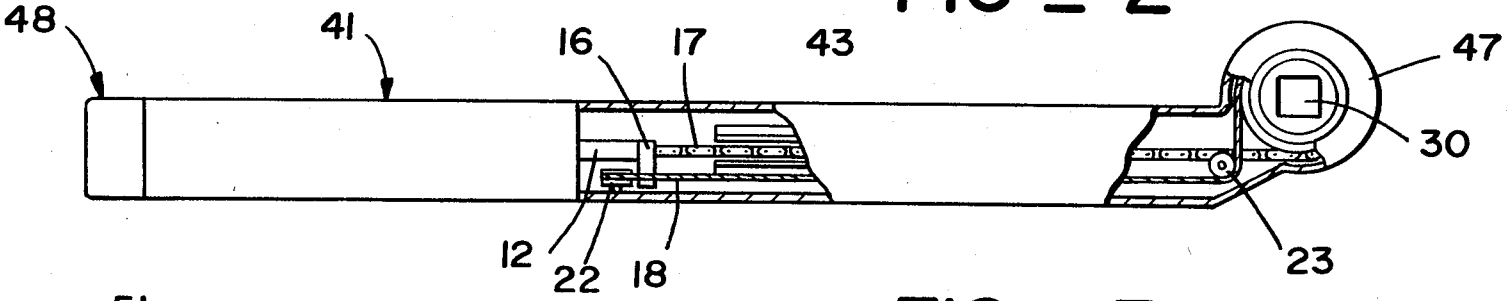
FIG. 3 is a partly cut-away elevation view of the wrench illustrated in FIG. 2.
Figure 4:
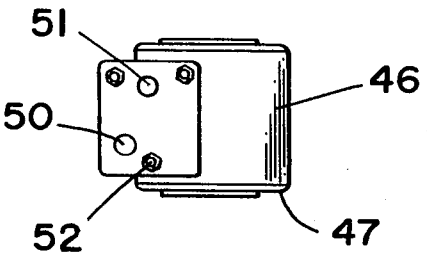
FIG. 4 is a left end view of the wrench illustrated in FIG. 2.

FIG. 1 illustrates the invention schematically while FIGS. 2, 3 and 4 illustrate a commercially acceptable embodiment of the invention. The tool illustrated in FIGS. 2, 3 and 4 is normally about 30 to 36 inches long in order to provide sufficient mechanical advantage to resist the reaction to the tightening stroke of the wrench. The device illustrated in FIGS. 2, 3 and 4 has three separate segments, front segment 40, rear segment 41, and fluid connection section 48, which may be bolted or otherwise fastened together. Front segment 40 includes the operating elements of the device and rear segment 41 generally includes the motor. The tension element 17 is in the form of a drive chain which is extremely strong, flexible in one direction, and very flat. Chain 17 is connected to yolk 16 at the end of piston rod 12 by means known to the art. Rails 43 are used to keep tension elements 17 centered within the housing 40 whether that element is in tension or not. The stroke of piston rod 12 is limited so that tension element 17 will wrap around drum 11 less than 360° for any complete stroke of piston rod 12.

Also connected to yoke 16 is a tension element 18 which is a small diameter cable in that it must only be strong enough to rewind cylinder 11. Tension element 18 runs below one of rails 43 and around pulley 23 so that it wraps around cylinder 11 in the direction opposite tension element 17. Tension element 18 also is limited by the stroke of piston rod 12 to wrap around cylinder 20 less than 360°. Cylinder 11 is wide enough so that tension element 18 is spaced from tension element 17 is not in contact with it during the functioning of the device.

A drum-like enclosure 46 surrounds cylinder 11 and tension elements 17 and 18 so that they are not visible during the operation of the device. The enclosure 46 is provided with side plates 47 which conceal the mechanism within enclosure 46 and act as bearings for the rotation of drum 11. The only rotating portion of the device that is visible in ordinary use is the driver 30 and that portion of ratchet element 27 immediately surrounding it.

The rear segment 41 contains the motor which includes cylinder 11 and piston rod 12. The end of rear segment 41, as illustrated in FIG. 4, is connected to a fluid connection section 48 which includes connections 50 for hydraulic fluid and 51 for compressed air. Connection 50 connects with line 13 while connection 51 connects with a line not visible in FIG. 2 but would be equivalent to line 15 in FIG. 1. Fluid connection section 48 preferably is removably secured to the rear segment 41 for example with threaded fasteners 52.

What is claimed is:

1. A torque wrench comprising:

a cylindrical spool mounted to rotate on its long axis and including one portion of a ratchet means, a ratchet element including a second portion of said ratchet means, mounted in an axial cavity within said cylindrical spool and engaged with said first portion of a ratchet means, a driver connected to said ratchet element to be coaxial with said cylindrical spool, a handle including a motor capable of reciprocal motion including a work stroke which provides a predetermined force and a return stroke, a first flexible tension element wrapped around the cylindrical surface of said spool in a first direction, having one end fixed to said cylindrical surface and the other end fixed to be put in tension by said work stroke, a second flexible tension element wrapped around the cylindrical surface of said spool in the direction opposite said first direction, said second tension element having one end fixed to said cylindrical surface and the other end fixed to be put in tension by a return stroke of said motor, and the length of said work stroke being limited so that said first tension element is wrapped around said cylindrical spool less than 360°.

2. The device of claim 1 wherein said motor is a fluid-operated piston-cylinder combination.

3. The device of claim 1 wherein said work stroke is hydraulically actuated.

4. The device of claim 1 wherein said return stroke is pneumatically actuated.

5. The device of claim 1 wherein said first tension element is a flat chain.

6. The device of claim 1 wherein said second tension element is a cable.

7. The device of claim 1 with a driver on either end of said ratchet element.

* * * * *